US006561499B2

(12) United States Patent
Lesenskyj et al.

(10) Patent No.: US 6,561,499 B2
(45) Date of Patent: May 13, 2003

(54) PICKET CLIP

(75) Inventors: Anthony Lesenskyj, Lawrenceville, NJ (US); James G. Fattori, Trevose, PA (US); George Lesenskyj, Robbinsville, NJ (US)

(73) Assignee: LMT Mercer Group, Inc., Lawrenceville, NJ (US)

( * ) Notice: Subject to any disclaimer, the term of this patent is extended or adjusted under 35 U.S.C. 154(b) by 74 days.

(21) Appl. No.: 09/840,263

(22) Filed: Apr. 23, 2001

(65) Prior Publication Data

US 2002/0104986 A1 Aug. 8, 2002

Related U.S. Application Data

(63) Continuation-in-part of application No. 09/777,276, filed on Feb. 6, 2001.

(51) Int. Cl.[7] ..... E04H 17/08
(52) U.S. Cl. ..... 265/65.01
(58) Field of Search ..... 403/155, 167, 403/376, 379.2, 397, 316–319, DIG. 14, 326, 329; 256/19, 22, 24, 59, 65.02, 65.01, 65.03; 52/357, 360, 489.1, 716.7, 238.1, 361, 301; 411/516, 466, 508, 509, 510, 913; 248/217.3, 222.11, 423, 222.14; 24/295, 293

(56) References Cited

U.S. PATENT DOCUMENTS

| | | | | |
|---|---|---|---|---|
| 2,282,631 A | * | 5/1942 | Winship | 248/217.3 |
| 3,276,179 A | * | 10/1966 | Rallis | |
| 3,881,293 A | * | 5/1975 | Conville | 52/238.1 |
| 4,068,440 A | * | 1/1978 | Lillethorup | 403/167 |
| 4,442,642 A | * | 4/1984 | Lindner et al. | 52/489.1 |
| 4,596,094 A | * | 6/1986 | Teller et al. | 52/357 |
| 4,897,005 A | | 1/1990 | Peterson et al. | |
| 5,275,381 A | | 1/1994 | Cluff et al. | |
| 5,402,897 A | | 4/1995 | Garfinkle | |
| 5,489,078 A | * | 2/1996 | Risley | |
| 5,556,079 A | * | 9/1996 | West | 256/22 X |
| 5,601,279 A | * | 2/1997 | Schwartz et al. | 256/19 |
| 5,639,049 A | * | 6/1997 | Jennings et al. | |
| 5,702,090 A | * | 12/1997 | Edgman | 256/19 |
| 5,887,637 A | | 3/1999 | Phyper | |
| 6,056,335 A | | 5/2000 | Dietrich | |
| 6,105,295 A | * | 8/2000 | Brinkman et al. | |
| 6,117,108 A | | 9/2000 | Woehr et al. | |
| 6,167,676 B1 | | 1/2001 | Shipman et al. | |
| 6,198,031 B1 | | 3/2001 | Jones | |
| 6,213,970 B1 | | 4/2001 | Nelson et al. | |

* cited by examiner

*Primary Examiner*—Gregory J. Binda
*Assistant Examiner*—Victor MacArthur
(74) *Attorney, Agent, or Firm*—Kenneth Watov; Watov & Kipnes, P.C.

(57) ABSTRACT

A clip for securing a picket cap to a profile of a picket fence consists of a U-shaped thin piece of stainless steel, or other suitable material, for frictionally fitting onto opposing end tabs protruding from a bottom portion of the picket cap. A backface of the picket clip has a barb-like portion formed thereon, and bent into an interior portion thereof for permitting the clip to be pushed onto one of the opposing tabs of the picket cap, but preventing the removal of the clip therefrom by digging into the material of an inside wall portion of the associated tab if an attempt is made to remove the clip from the associated tab. One such clip is installed on the two opposing tabs. The front face of the clip includes a topmost barb portion comprising one or more projecting teeth bent away from the clip, for digging into an inside wall portion of a recess in the top of an associated vertical profile into which the tabs of the picket cap are inserted, to prevent removal of the associated picket cap from the profile.

9 Claims, 9 Drawing Sheets

PICKET CLIP

RELATED APPLICATION

This is a Continuation-In-Part Application of a co-pending U.S. patent application Ser. No. 09/777,276, filed Feb. 6, 2001, entitled "PICKET CLIP", and both are assigned to the same Assignee as the present Application.

FIELD OF THE INVENTION

The present invention relates generally to picket fences, and more particularly to picket fences fabricated from plastic components, and mechanisms for securing picket caps to profiles or slats of the fence.

BACKGROUND OF THE INVENTION

Picket fences fabricated from plastic materials, and other artificial materials, typically require the use of adhesives, screws, and so forth for securing the various components of the fence together. The use of screws for securing components of a picket fence together can be time consuming, and the screws can come loose over time. Also, the use of adhesives is not only time consuming for securing parts together, but requires extra clean up measures. One particularly troublesome area in assembling picket fences fabricated from plastic materials is the securement of picket caps to vertical profiles or slats of a picket fence.

SUMMARY OF THE INVENTION

One object of the invention is to provide an improved mechanism for securing a picket cap to a vertical profile of a picket fence consisting of plastic material.

Another object of the invention is to provide an improved mechanism for securing a picket cap to the top end of a profile of a picket fence of plastic or similar material.

With these and other objects in mind, and in view of the problems in the art, the present invention includes generally U-shaped clips of appropriate material for installation on opposing end tabs of a picket cap. A backside of the clip includes an inwardly extending and downwardly projecting partial cut-out portion for providing one or more barb members that partially embeds itself into a portion of the inside wall of the associated end tab or tabs of a picket cap the clip is installed on, for preventing removal or dislodgement of the clip from the end tab or tabs of the associated picket cap. The front face of the clip is in one embodiment of the invention can be shorter or longer than the backface of the clip, and has a front lip portion bent away from the clip body at an angle sufficient for having the bent lip portion act as a barb for partially penetrating into an associated inside wall of a profile into which the associated end tab of a picket cap is installed or pushed into. The barb-like lip of the front face of the clip extends across the full width of the front face, and prevents the picket cap once installed in the open end of a profile from being removed from the profile. Accordingly, in one embodiment of the invention, with the inventive clips installed on opposing end tabs of a picket cap, once the associated cap is installed on the end of a profile, it will become securely attached thereto, thereby enhancing the reliability and durability of the associated picket fence.

In a second embodiment of the invention, the above-described U-shaped clips may instead of a front lip portion, include one or more teeth bent away from the clip body at an angle sufficient for having the teeth portion act as a barb for preventing movement of the corresponding mated component parts, i.e., the picket cap and the profile fence.

In another embodiment of the invention, the U-shaped clips of the invention may be conveniently installed on an edge portion of a top opening of a profile of a fence post with the partial cut-out portion on the backside of the clip projecting upwardly for providing a barb member that partially penetrates into an associated inside wall of the profile. The barb-like lip or teeth of the front face of the clip extends along the width of the front face, and prevents a post cap configured to fit over and around the top opening of the profile from being removed therefrom. The barb-like lip or teeth of the clip embeds itself into the inside surface of the installed post cap. Accordingly, with the inventive clips installed on the edge portion of the open end of the profile, the post cap will become securely attached to the profile, thus enhancing the reliability and durability of the associated picket fence.

BRIEF DESCRIPTION OF THE DRAWINGS

Various embodiments of the present invention are described in detail below with reference to the drawings, in which like items are identified by the same reference designation, wherein.

DETAILED DESCRIPTION OF THE INVENTION

Figure 1:
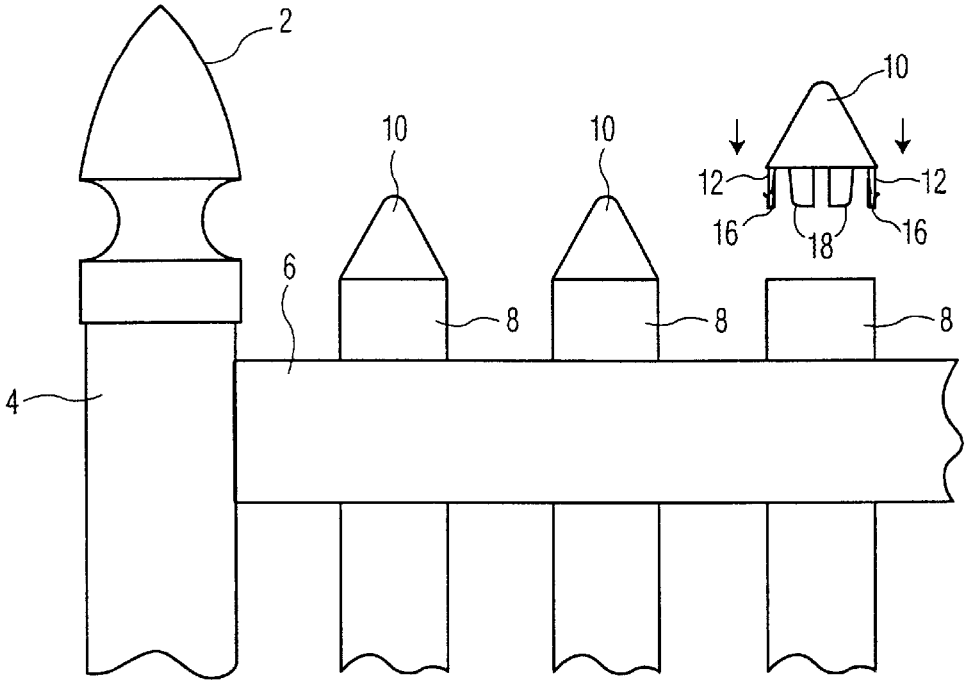
FIG. 1 shows a side elevational view of a picket fence incorporating one embodiment of the invention.

In FIG. 1, a portion of a picket fence fabricated from plastic or similar material is shown. The fence includes a post cap 2 secured to the top of a post 4, with a horizontal profile 6 secured to an upper inside side portion of the post 4, as shown. A plurality of vertical profiles are rigidly secured to the horizontal profile and spaced apart juxtapositioned to one another, as shown. Two of the vertical profiles 8 shown have picket caps 10 secured to their top portions. One of the vertical profiles 8 as shown just before assembly with a picket cap 10 that includes opposing end tabs 12 having clips 16, respectively, secured thereto, and spaced apart side tabs 18, as shown. As will be explained in greater detail below, after the picket cap 10 has its end tabs 12 and side tabs 18 pushed into an opening in the top of the associated vertical profile 8, through use of the inventive clips 16 the picket cap 10 will be installed to the associated vertical profile 8.

Figure 2:
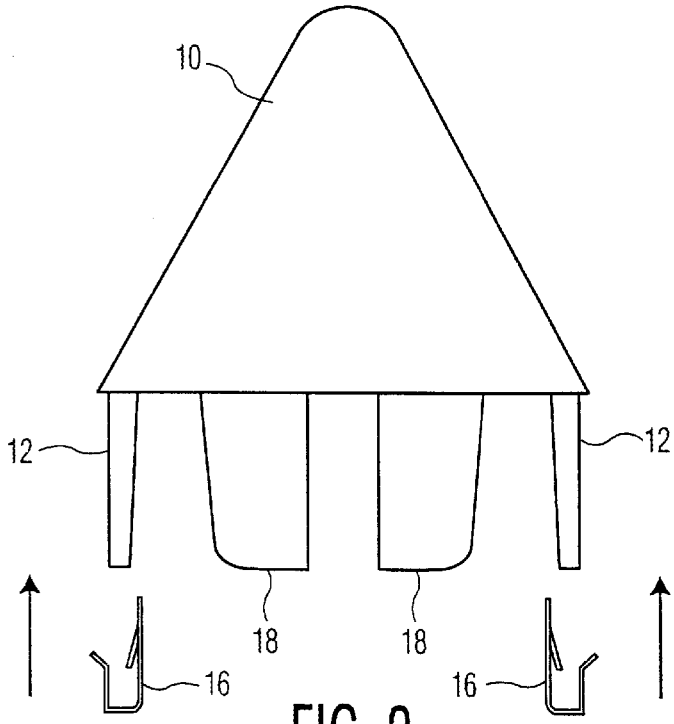
FIG. 2 is a side elevational view showing an exploded assembly view of picket clips for one embodiment of the invention in the process of being installed on opposing end tabs of a picket cap.
Figure 3:
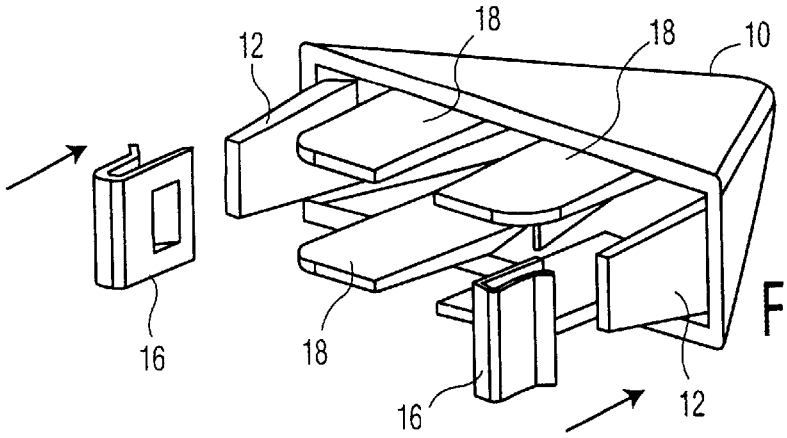
FIG. 3 is a pictorial view of the exploded assembly diagram of FIG. 2, looking toward the bottom of a picket cap.
Figure 4:
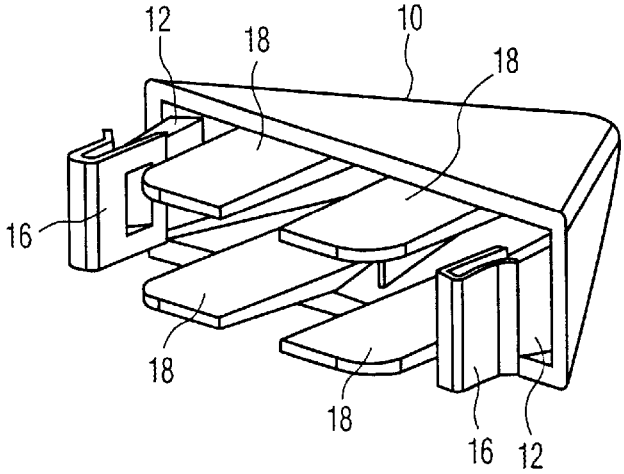
FIG. 4 shows a pictorial view looking toward the bottom of a picket cap with the clips of one embodiment of the invention installed on opposing end tabs of the picket cap.

In the exploded assembly diagram of FIG. 2, clips 16 are shown just prior to being pushed onto opposing end tabs 12 of a picket cap 10. This is more clearly shown in the pictorial view of FIG. 3. The pictorial view of FIG. 4 shows the clips 16 installed on the opposing end tabs 12 of the associated picket cap 10.

Figure 5:
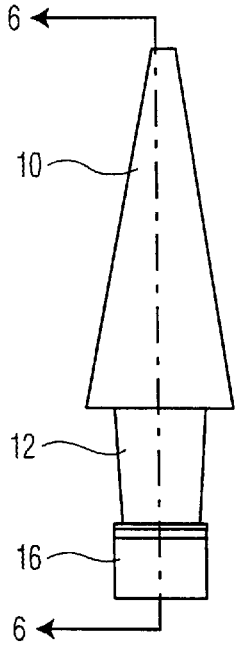
FIG. 5 is a side elevational view of the picket cap of FIG. 4.
Figure 6:
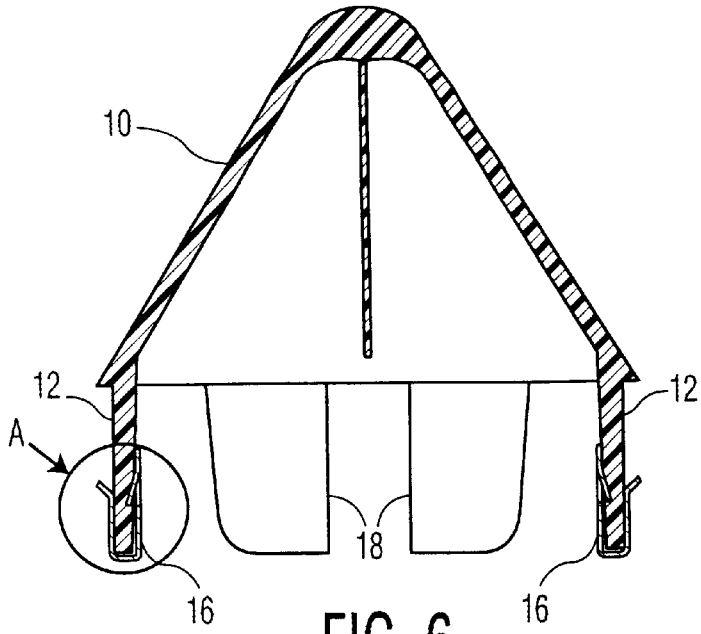
FIG. 6 is a cross sectional diagram taken along 6—6 of FIG. 5.
Figure 7:
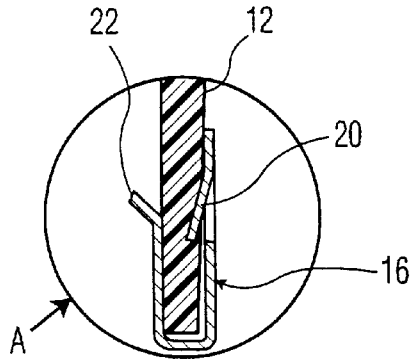
FIG. 7 is an enlarged view of the "A" designated area of FIG. 6, for more clearly showing the securement of a clip to an end tab of a picket cap for one embodiment of the invention.
Figure 8:
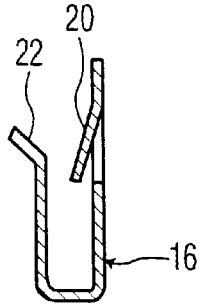
FIG. 8 shows the sectional view of the clip of FIG. 7 for showing typical dimensions and angles for an embodiment of the invention.

The side elevational view of FIG. 5 shows a clip 16 of the present invention as installed on an end tab 12 of the associated picket cap 10. The cross sectional view of FIG. 6 taken along 6—6 of FIG. 5 shows securement features of the clip 16 for retaining it on an associated end tab 12, once installed thereon. The enlarged view of area A, as shown in FIG. 7, more clearly shows that the clip 16 includes a partially cutout portion for permitting the formation of at least one barb 20 by pushing the partially cutout portion of the clip material inward. Juxtaposed cutout portions can also be provided for forming a number of barbs 20. The barb(s) 20 tends to dig into or protrude partly into the material of the associated end tab 12, and will even more rigorously dig into the material if an attempt is made to pull the associated clip 16 off of the end tab 12. The clip 16 also includes a lip portion at the top of the front face that is bent away from the clip for forming a front face barb 22 to prevent the associated picket cap 10 from being pulled away from the top of a vertical profile 8 once installed therein, as will be described in greater detail below. An example of dimensions in inches or portions of an inch for a typical clip 16 are shown in FIG. 8, along with the bend angles of the back face barb(s) 20, and front face barb 22. It should be noted that the dimensions are given for purposes of illustration only, and are not meant to be limiting. The clip 16 can be dimensioned as required for accommodating the dimensions of any particular fence and associated picket caps.

Figure 9:
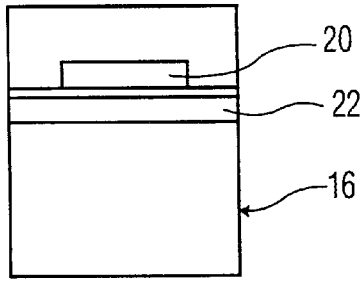
FIG. 9 is a front elevational view of the clip of FIG. 8.
Figure 10:
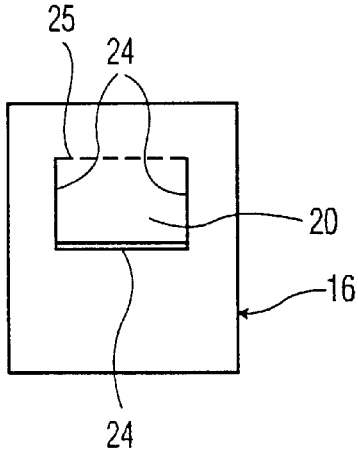
FIG. 10 is a back or rear elevational view of the clip of FIG. 8.
Figure 11:
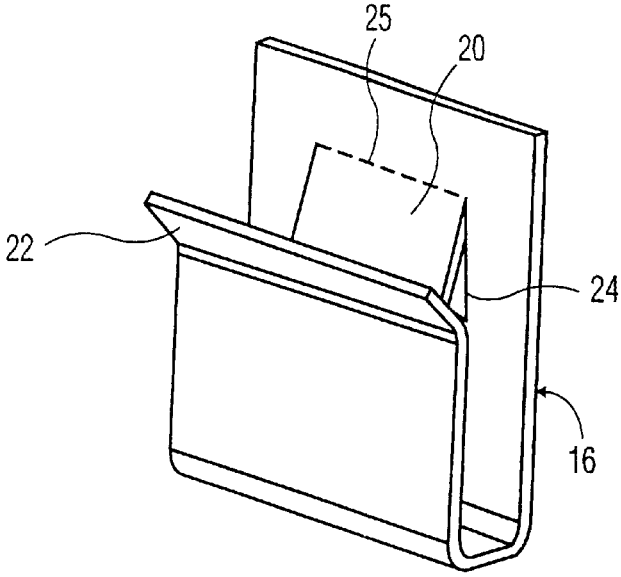
FIG. 11 is a pictorial view of a clip for one embodiment of the invention.

In FIG. 9, a front elevational view of the clip 16 of FIG. 8 is shown. FIG. 10 shows a back elevational view of the clip 16, and FIG. 11 a pictorial view thereof. Note the partially cut through portions 24 on the back face of the clip 16 for providing the barb(s) 20 which is formed by bending the partially cutout portion along with fold line 25 to protrude into the interior clip 16. Also as clearly illustrated, the front face barb 22 is formed by a top lip of the front face of clip 16 that is bent away from the interior portion of the clip 16, as shown.

Figure 12:
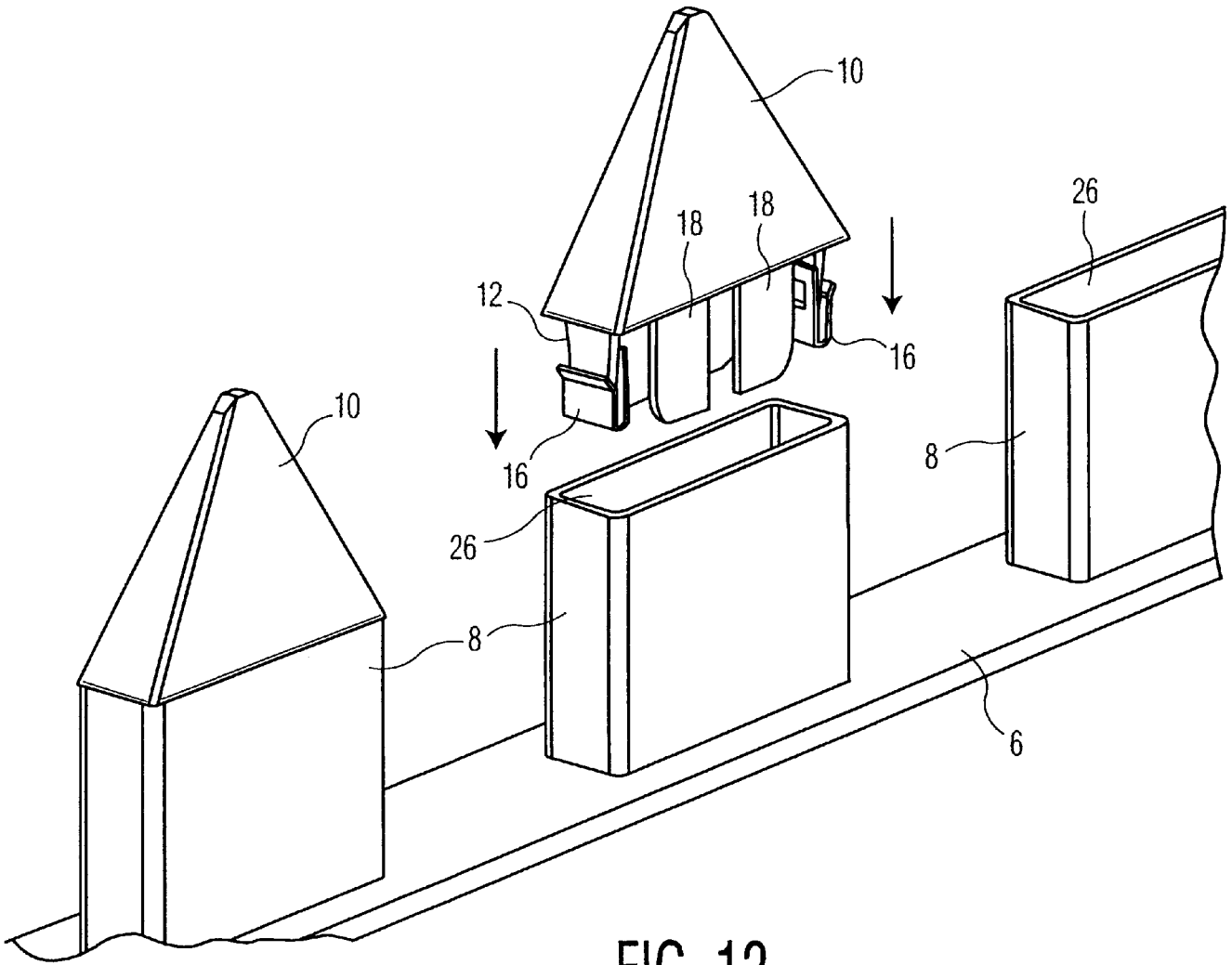
FIG. 12 is a partial pictorial view of a picket fence showing a picket cap with clips of one embodiment of the invention installed on opposing end tabs thereof, just prior to insertion of the bottom portion of the picket cap 10 into a top opening of a vertical profile of the picket fence.

FIG. 12 shows a pictorial view of a portion of a picket fence. As shown in this embodiment, the vertical profiles 8 include a hollow top portion 26 that in this example is rectangular in shape, for receiving the bottom portion of a picket cap 10. As shown, for the centermost vertical profile, a picket cap 10 with clips 16 installed on opposing end tabs 12 is positioned for being pushed into the open end 26 of a vertical profile 8 for securement of the picket cap 10 thereto. Note that the side tabs 18 are designed for frictionally engaging inside surfaces of the front and back portions of the associated vertical profile 8 to centralize/align the cap 10 to the profile 8.

Figure 13:
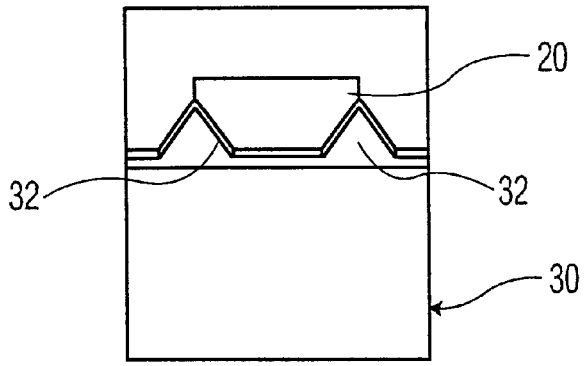
FIG. 13 is a front elevational view of a clip for a second embodiment of the invention.
Figure 14:
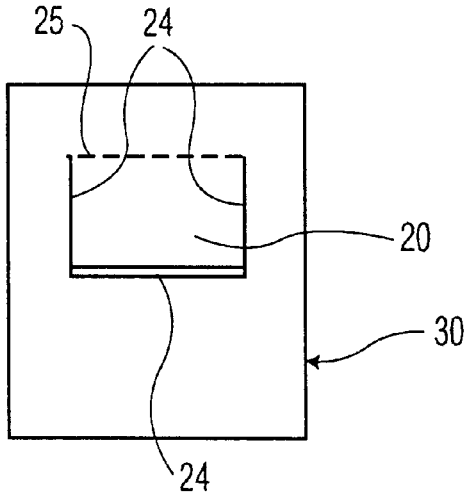
FIG. 14 is a rear elevational view of the clip of FIG. 13.
Figure 15:
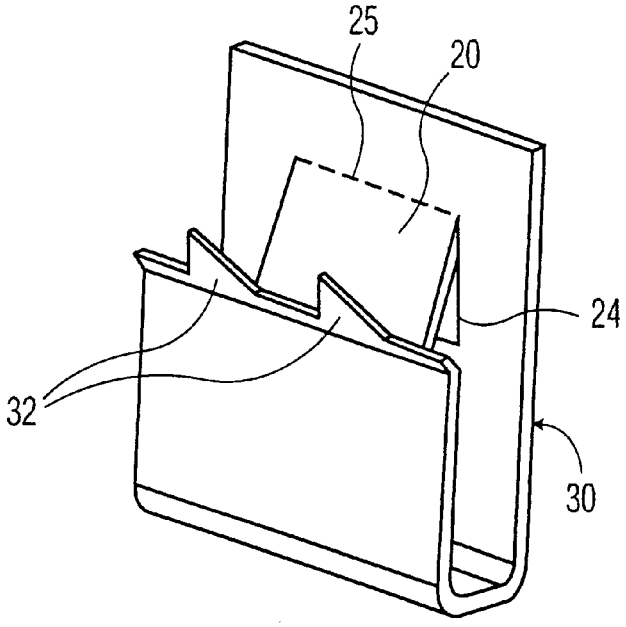
FIG. 15 is a pictorial view of the clip of FIG. 13.

Referring to FIGS. 13 to 15, a second embodiment of a picket clip 30 is shown in various views. The clip 30 is similar to the clip 16 of the first embodiment of the invention, in all respects except for the configuration of the front face barb-like projections. The clip 30 further comprises a pair of teeth 32 extending from the top of the front face that is bent away at an angle sufficient to form the barb-like projections as best shown in FIG. 15. The clip 30 includes a partially cut-out portion for permitting the formation of a barb(s) 20 by pushing the partially cutout portion(s) of the clip material inward. The barb(s) 20 tends to dig into or protrude partly into the material of the associated component part, and will even more rigorously dig into the material if an attempt is made to pull the associated clip 30 off of the mounted part. The teeth 32 at the top of the front face are bent away from the clip 30 to prevent the associated picket cap 10 from being pulled away from the top of a vertical profile 8 once installed therein, as will be described in greater detail below.

Figure 16:
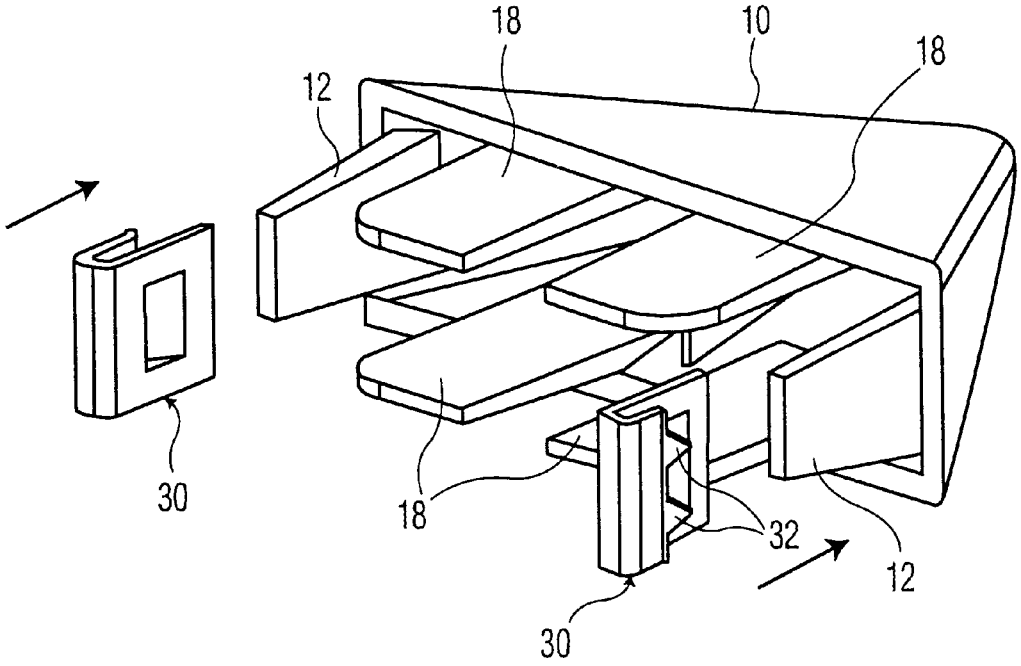
FIG. 16 is a pictorial view showing an exploded assembly diagram of the picket clip for a second embodiment of the invention, in the process of being installed on opposing end tabs of a picket cap looking toward the bottom thereof.
Figure 17:
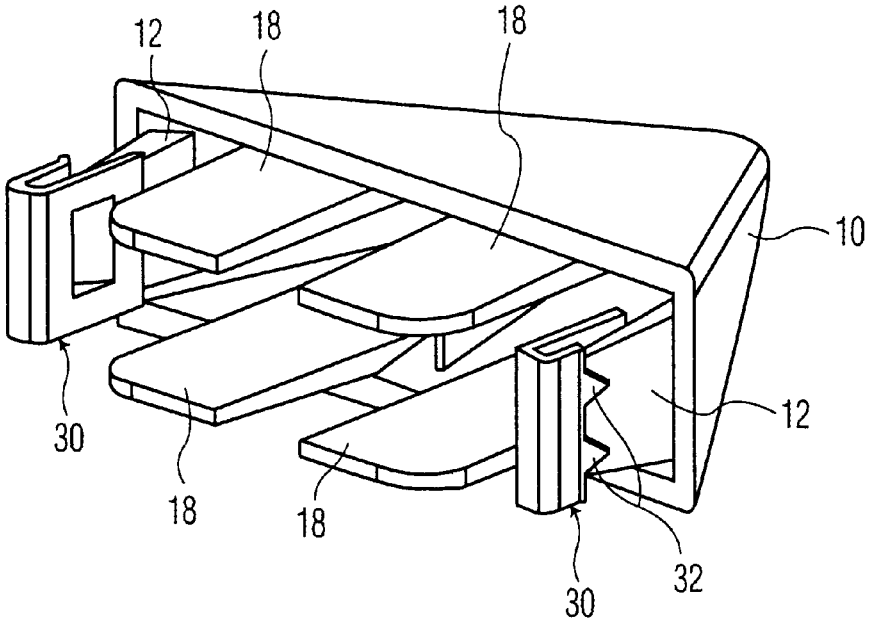
FIG. 17 shows a pictorial view looking toward the bottom of the picket cap with the clips of the second embodiment of the invention installed on opposing end tabs of the picket cap.

In the exploded assembly diagrams of FIGS. 16 and 17, the clips 30 are shown just prior and after, respectively, to being pushed onto opposing end tabs with the teeth 32 oriented outward from the end tabs 12.

Figure 18:
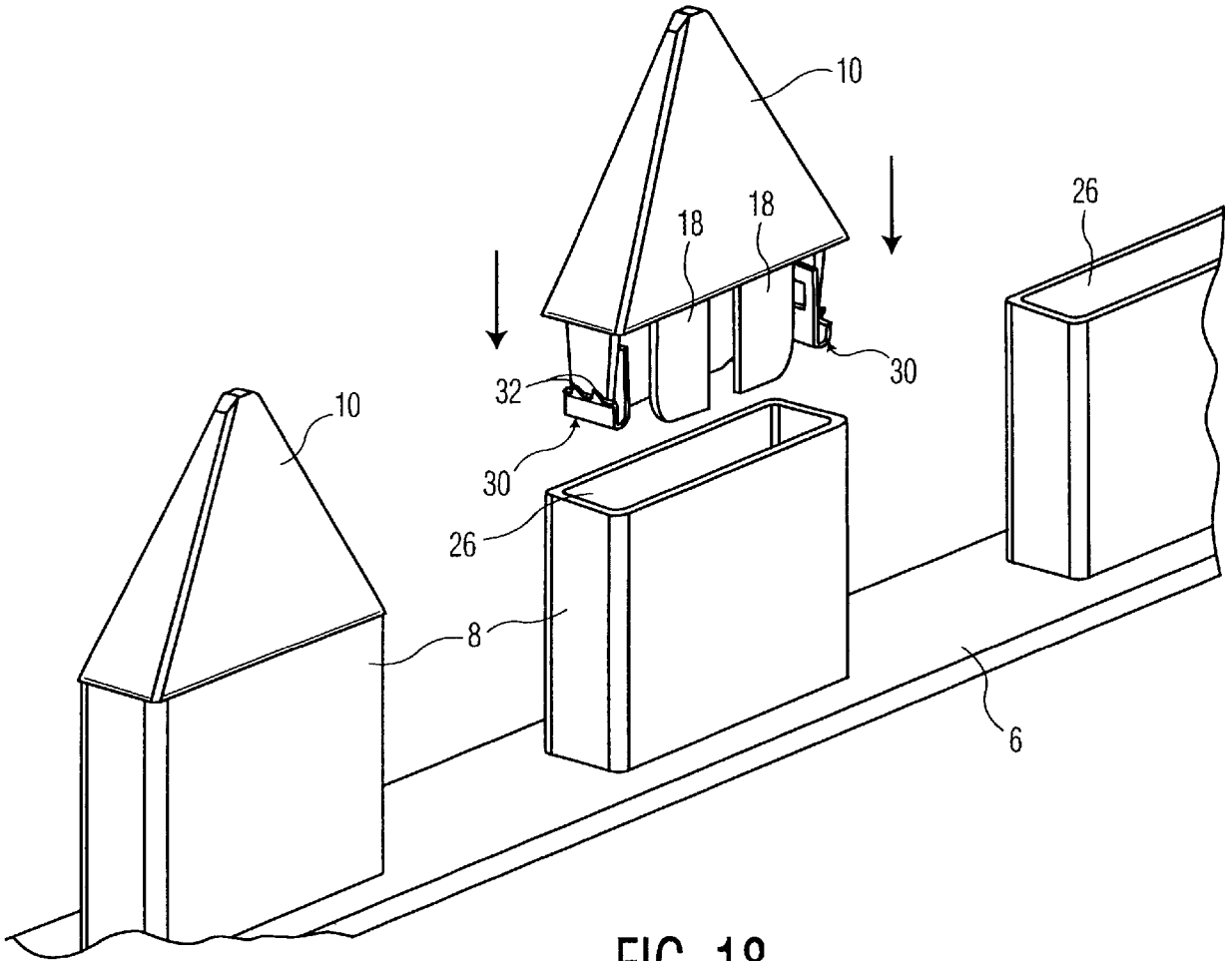
FIG. 18 is a partial pictorial view of a picket fence showing a picket cap with clips of the second embodiment of the invention installed on opposing tabs thereof, just prior to insertion of the bottom portion of the picket cap into a top opening of a vertical profile of the picket fence.

FIG. 18 shows a pictorial view of a portion of a picket fence. As shown in this embodiment, the vertical profiles 8 include a hollow top portion 26 that in this example is rectangular in shape, for receiving the bottom portion of a picket cap 10. As shown, for the centermost vertical profile, the picket cap 10 with clips 30 installed on opposing end tabs 12 is positioned for being pushed into the open end 26 of a vertical profile 8 for securement of the picket cap 10 thereto. Note that the side tabs 18 are designed to frictionally engaging the inside surfaces of the front and back portions of the associated vertical profile 8 to centralize and align the cap 10 to the profile 8. Once installed, the teeth 32 are strongly biased against the inside surface of the associated vertical profile 8 and sharply dig into the material of the vertical profile 8 for effective and secure retainment therein. Concurrently, the barb 20 on the back face portion of the clip 30 is biased strongly against the inside surface of the end tab 12 for retainment the picket cap 10 in the vertical profile 8.

Figure 19:
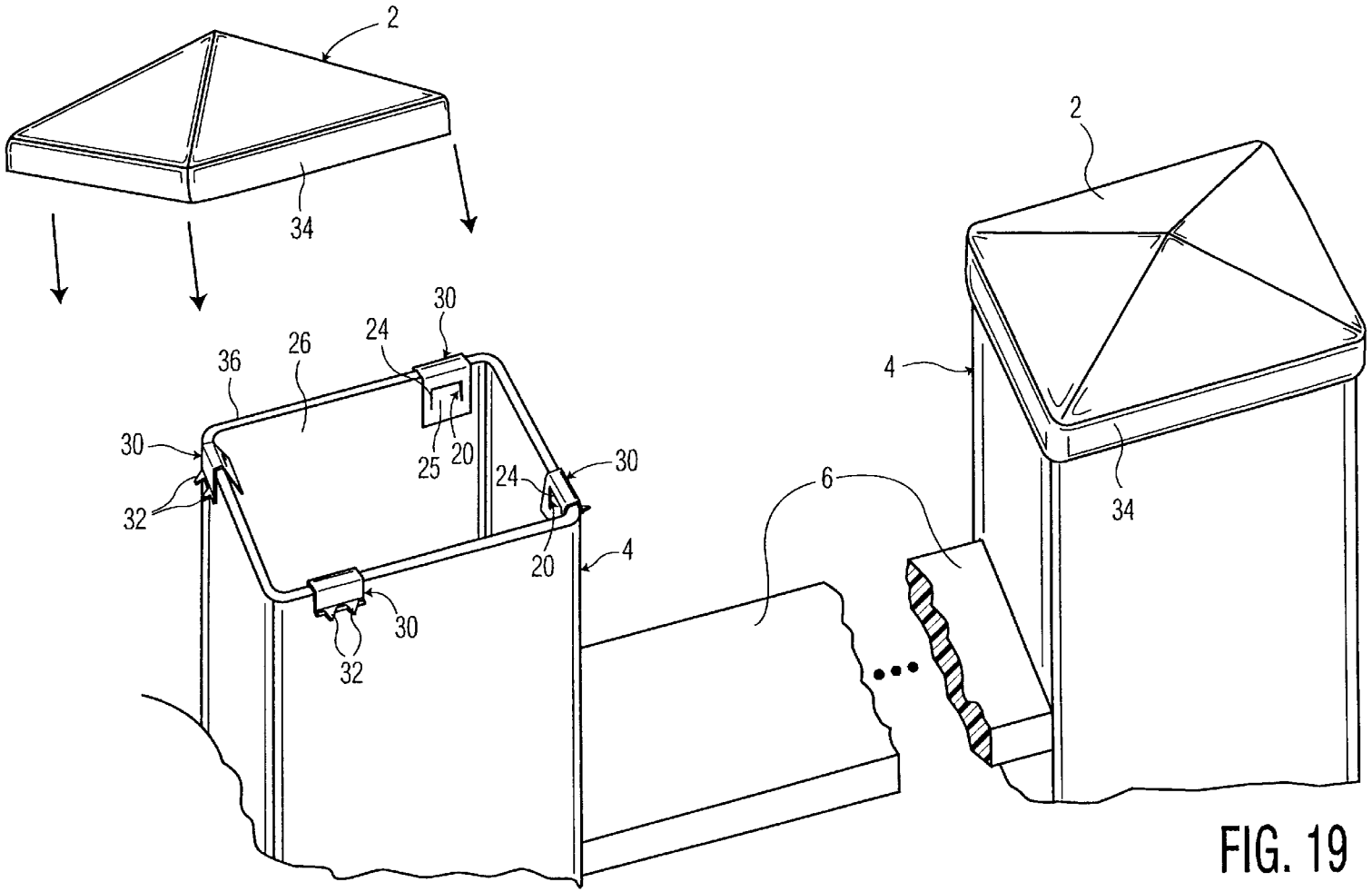
FIG. 19 is a partial pictorial view of a vertical profile of a picket post with clips of the second embodiment of the invention installed in edge portions of the top opening thereof, showing a post cap just prior to placement over the top opening of the vertical profile of the picket post for permanent retainment.

With reference to FIG. 19, a partial pictorial view of the-fence post 4 and the post cap 2 is shown using the clips 30 of the present invention. It is noted that the clips 16 may also be used for fence assemblies of this configuration. In this fence configuration, the post cap 2 is configured to be mounted over the open end 26 of the fence post 4. The post cap 2 includes a rim portion 34 which fits around the outer surface proximate the open end 26. One or more clips 30 are mounted to edge portions 36 at the top of the open end 26, preferably near the corner portions. The barb(s) 20 is biased against the inside surface of the fence post 4, and the teeth 32 extends outward and downwardly on the outer surface of the fence post 4.

The post cap 2 is mounted over the open end 26 where the teeth 32 of each clip 30 contacts and digs into the inside surface of the rim portion 34 of the post cap 2 for secure retainment thereon. Once the post cap 2 is fully mounted, the clips 30 are hidden under the post cap 2. Again, it is noted that clips 16 may be use here in a similar fashion and positioned so that the front face barb 22 is located on the outer side of the fence post 4. The technique is also applicable where the vertical profile 8 and the picket cap 10 are similarly configured to have the picket cap 10 to be mounted over the open end 26 of the vertical profile 8.

Although various embodiments of the invention have been shown and described, they are not meant to be limiting. Those of skill in the art may recognize certain modifications to these embodiments, which modifications are meant to be covered by the spirit and scope of the appended claims. For example, the vertical profiles 8 or 4 of the fence can be configured to be other than rectangular, such as square, round, or rectangular, for example. The design of the picket cap 10 and post cap 2 will vary in accordance with the design of the associated profiles, with the design being modified in a manner for permitting the clip 16 and 30 to permanently secure the picket cap 10 and post cap 2 to the associated vertical profiles 8 and 4, respectively, as previously described. Also, the clip 16 and 30 in a preferred embodiment of the invention consists of stainless steel, but can be made from any other suitable material. In addition, the clip 16 and 30 may also be installed on the side tabs 18 of a picket cap 10 in addition to being installed on the end tabs 12, or in some combination thereof. Also, although vertical profiles 8 are illustrated, the invention is also applicable for use with horizontal profiles, or profiles at an angle.

What is claimed is:

1. A dual use clip for fence assemblies for non-removably securing a first cap to a first profile, and a second cap to a second profile; said first cap including a closed top portion, a bottom portion having a circumference configured to cover the circumference of a top opening of said first profile, and at least two opposing tabs protruding outward from inside wall surfaces within an opening at the bottom thereof, said tabs being configured to fit snugly against inside wall surfaces of said first profile when said first cap is installed thereon; said second cap including a closed top portion terminating in a bottommost circumferential apron about a bottom opening thereof, said apron being configured to fit snugly about sidewall portions proximate a top opening in said second profile upon installing said second cap thereon, said clip comprising:

a single U-shaped piece of material having a front face including at least one first barb bent away from an interior portion, a bottom portion, and a back face including at least one second barb bent into an interior portion toward said bottom portion, said bottom portion being dimensioned for maintaining a distance between said front and back faces in opposition to permit a said clip to be frictionally fitted onto respective end portions of the tabs of said first cap, and edge portions about the circumference of the top opening of said second profile;

a said clip being installed on each of said at least two opposing tabes of said first cap, each said clip being oriented with their respective first barb facing toward an exterior of said first cap, whereby when said first cap is installed on said first profile, upon movement of said first cap away from said first profile, said at least one first barb of each said clip digs into an inside wall portion of said first profile, and said at least one second barb digs into an inside wall portion of an associated said tab, thereby preventing removal of said first cap from said first profile; and a said clip being installed on each of at least two opposing side edges of said second profile, each said clip being oriented with its at least one second barb against an inside wall portion of said second profile, when said second cap is installed on said second profile, whereby upon movement of said second cap away from said second profile, said at least one first barb of each said clip digs into an inside wall portion of the apron of said second cap, and said at least one second barb of each said clip digs into the inside wall portion of said second profile, thereby preventing removal of said second cap from said second profile.

2. The dual use clip of claim 1, wherein said first barb includes one or more teeth.

3. The dual use clip of claim 1, wherein said first barb is comprised of an entire top edge portion of said front face.

4. A fence assembly for non-removably securing a cap on a profile, said fence assembly comprising:

a plurality of clips, each one of said plurality of clips being identical and including:

a single U-shaped piece of material having a front face including at least one first barb bent away from an interior portion, a bottom portion, and a back face including at least one second barb bent into an interior portion toward said bottom portion, said bottom portion being dimensioned for maintaining a distance between said front and back faces in opposition to permit each of said plurality of clips to be frictionally retained on portions of said cap;

said cap including:

a closed top portion, a bottom portion having a circumference configured to the circumference of a top opening of said profile, and at least two opposing tabs protruding outward from inside wall surfaces within an opening at the bottom thereof, said tabs being configured to fit snugly against inside wall surfaces of said profile;

said profile including an open top on which said cap is mounted; and one of said plurality of clips being installed on each of said at least two opposing tabs of said cap, each said clip being oriented with their respective first barb opposing an inside wall portion of said profile, whereby when said cap is installed on said profile, upon movement of said cap away from said profile, said at least one first barb of each said clip digs into an inside wall portion of said first profile, and said at least one second barb digs into an inside wall portion of an associated said tab, thereby preventing removal of said cap from said profile.

5. The fence assembly of claim 4, wherein the said first barb of each one of said plurality of clips includes one or more teeth.

6. The fence assembly of claim 4, wherein the first barb of each one of said plurality of clips includes an entire top edge portion of said front face.

7. A fence assembly for non-removably securing a cap on a profile, said fence assembly comprising:

a plurality of clips, each one of said plurality of clips being identical and including:

a single U-shaped piece of material having a front face including at least one first barb bent away from an interior portion, a bottom portion, and a back face including at least one second barb bent into an interior portion toward said bottom portion, said bottom portion being dimensioned for maintaining a distance between said front and back faces in opposition to permit each of said plurality of clips to be frictionally retained on portions of said profile;

said profile including an open top;

said cap including:

a closed top portion terminating in a bottommost circumferential apron about a bottom opening thereof, said apron being configured for fitting snugly about sidewall portions proximate said top opening of said profile when installed thereon;

one of the said plurality of clips being installed on at least two opposing side edges of said profile, each said clip being oriented with its said at least one second barb against an inside wall portion of said profile, and its at least one first barb against an inside wall portion of the apron of said cap, when said cap is installed on said profile, whereby upon movement of said cap away from said profile, said first barb of each said clip digs into the inside wall portion of the apron of said cap, and said second barb of each said clip digs into the inside wall portion of said profile, thereby preventing removal of said cap from said profile.

8. The fence assembly of claim 7, wherein the first barb of each one of said plurality of clips includes one or more teeth.

9. The fence assembly of claim 7, wherein the first barb of each one of said plurality of clips includes an entire top edge portion of said front face.

* * * * *